US006584990B2

(12) United States Patent
Shaw

(10) Patent No.: US 6,584,990 B2
(45) Date of Patent: Jul. 1, 2003

(54) STEAM MOP

(75) Inventor: Robin Roger Shaw, Mount Waverley (AU)

(73) Assignee: Dervin International Pty. Ltd., Mt. Waverley (AU)

( * ) Notice: Subject to any disclaimer, the term of this patent is extended or adjusted under 35 U.S.C. 154(b) by 62 days.

(21) Appl. No.: 09/765,822

(22) Filed: Jan. 19, 2001

(65) Prior Publication Data

US 2002/0096201 A1 Jul. 25, 2002

(51) Int. Cl.[7] ..... B08B 3/00

(52) U.S. Cl. ..... 134/105; 134/108; 134/201; 134/198; 219/272; 219/273; 219/275; 15/320; 15/321; 15/322

(58) Field of Search ..... 134/35, 36, 37, 134/105, 201, 108, 198; 219/272, 273, 215; 15/320, 321, 322

(56) References Cited

U.S. PATENT DOCUMENTS

| | | | | |
|---|---|---|---|---|
| 1,527,224 A | | 2/1925 | Riordan | |
| 1,724,267 A | | 8/1929 | Field | |
| 1,801,135 A | | 4/1931 | Blogg | |
| 1,803,693 A | | 5/1931 | Cutting | |
| 3,061,959 A | | 11/1962 | Blumenfeld | |
| 3,646,317 A | * | 2/1972 | Osrow | 392/337 |
| 3,755,850 A | | 9/1973 | Porter | |
| 3,889,406 A | * | 6/1975 | Chivers et al. | 38/77.83 |
| 4,308,636 A | | 1/1982 | Davis | |
| 4,414,037 A | * | 11/1983 | Friedheim | 122/40 |
| 4,696,074 A | | 9/1987 | Cavalli | |
| 5,114,255 A | | 5/1992 | Villarreal | |
| 5,502,872 A | | 4/1996 | Chae et al. | |
| 5,920,952 A | | 7/1999 | Baldacci | |
| 6,314,972 B1 | * | 11/2001 | Sin | 134/105 |

FOREIGN PATENT DOCUMENTS

| | | | | |
|---|---|---|---|---|
| CS | 80214 | | 2/1951 | |
| DE | 30 31 263 A 1 | | 2/1982 | |
| DE | 20015160 | | 11/2000 | |
| EP | O 458 542 A1 | | 11/1991 | |
| EP | 0625331 | | 11/1994 | |
| EP | 0972875 | | 1/2000 | |
| EP | 1027855 A2 | * | 8/2000 | A47L/5/24 |
| GB | 2091992 | | 8/1982 | |
| GB | 2294196 A | * | 4/1996 | A47L/13/20 |
| WO | WO 9926522 | | 6/1999 | |

OTHER PUBLICATIONS

European Patent Office (EPO) Application No. 02001338.9 Search Report dated Apr. 19, 2002.

European Patent Office (EPO) Application No. 02001338.9 Search Report dated Jul. 25, 2002.

* cited by examiner

*Primary Examiner*—Randy Gulakowski
*Assistant Examiner*—Gentle E. Winter
(74) *Attorney, Agent, or Firm*—Birdwell, Janke & Durando, PLC

(57) ABSTRACT

A steam mop. A housing contains a water reservoir for storing water and a heating plate outside the water reservoir. The reservoir dispenses water to the heating element which heats the dispensed water to produce steam substantially instantaneously. The reservoir preferably includes a mechanism for dispensing additional water to the heating element on demand to produce a "burst of steam." Preferably an absorbent cloth to which is attached a relatively stiff perimeter frame adapted to fit around the bottom of the housing is provided, the cloth assembly being easily removable for cleaning.

15 Claims, 1 Drawing Sheet

STEAM MOP

BACKGROUND OF THE INVENTION

The invention relates generally to a steam mop, particularly for steam cleaning smooth floor surfaces, such as linoleum, wood and tile.

As there has been an increased interest in environmentally friendly methods for household cleaning, the interest in steam cleaning in the home has also increased. This method of cleaning has the advantage of using water rather than chemicals which are expensive and sometimes hazardous to use or dispose of. Steam cleaning apparatus has, however, often been too bulky and expensive for household use.

An improvement to steam cleaning apparatus was proposed by Baldacci in U.S. Pat. No. 5,920,952. The object was to provide a steam-cleaning appliance that is easier to maneuver, more compact, simpler to use and safer to fill. The Baldacci appliance includes a boiler having a heating element contained therein. The water needed to produce the steam is poured into the boiler, and steam produced rises to the top of the boiler and escapes through a manifold to be dispensed on the floor surface which it is desired to clean.

One problem with much of the prior art including the appliance of Baldacci, however, is that there is no means for increasing or otherwise controlling the amount of steam produced as the appliance is being used. The present inventor has recognized that, particularly where the appliance employs a boiler as in Baldacci for heating the water to produce the steam, there is typically no means for providing a substantially instantaneous increase in the amount of steam produced in the appliance, such as is commonly provided in an iron, for example.

The head of the cleaning appliance of Baldacci includes a housing to be maneuvered on a floor surface, the bottom of which is connected to a base fitted with a handle. A removable cloth is secured to the bottom of the base by means of a hook and loop fastener. One fastening portion of the hook and loop fastener is apparently attached to the cloth and the other portion of the hook and loop fastener is apparently attached to the bottom of the base. The removable cloth is an important advance; however, to remove or install the cloth requires aligning the hook and loop fastener portions of the cloth with mating portions underneath the appliance, which generally necessitates tipping the appliance on its side or turning the appliance up-side down. These manipulations of the appliance are troublesome and awkward, especially because a relatively long handle extends from the apparatus for enabling its use to clean a floor from a standing position.

Accordingly, there is a need for a steam mop that provides, in a compact form particularly adapted for use in the home, a means for providing a substantially instantaneous increase in the amount of steam produced and an increased facility for removably attaching a cleaning cloth.

SUMMARY OF THE INVENTION

The steam mop according to the present invention solves the aforementioned problem and meets the aforementioned need by providing a housing adapted for resting on a floor surface and a handle connected to the housing having sufficient length to permit maneuvering the housing on the floor surface from a standing position. The housing contains a steam producing portion of the mop comprising a water reservoir for storing water and a heating plate outside the water reservoir. The reservoir dispenses water to the heating element which heats the dispensed water to produce steam substantially instantaneously. The steam is carried through apertures at the bottom of the housing which direct the steam toward the floor surface.

The reservoir is adapted to feed water to the heating element at a predetermined rate, preferably by gravity. However, the reservoir preferably includes a mechanism for dispensing additional water to the heating element on demand to produce a "burst of steam."

Preferably, an absorbent cloth is provided over the bottom of the housing to make contact with the floor surface. Preferably as well, a relatively stiff perimeter frame is attached to the cloth to form a cloth assembly that is adapted to fit snugly around the bottom perimeter of the housing, to secure the cloth to the steam mop.

The cloth assembly is easily fitted to the housing by lifting the mop a few inches off the floor, sliding the cloth assembly underneath the mop, and setting the housing of the mop down inside the perimeter frame.

Therefore, it is a principal object of the present invention to provide a novel and improved steam mop.

It is another object of the present invention to provide a steam mop that is compact, easy to maneuver, and simple and safe to use.

It is yet another object of the present invention to provide a steam mop particularly adapted for cleaning floors in the home.

It is still another object of the present invention to provide a steam mop that provides a means for providing a substantially instantaneous increase in the amount of steam produced.

It is a further object of the present invention to provide a steam mop that provides an increased facility for removably attaching a cleaning cloth.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
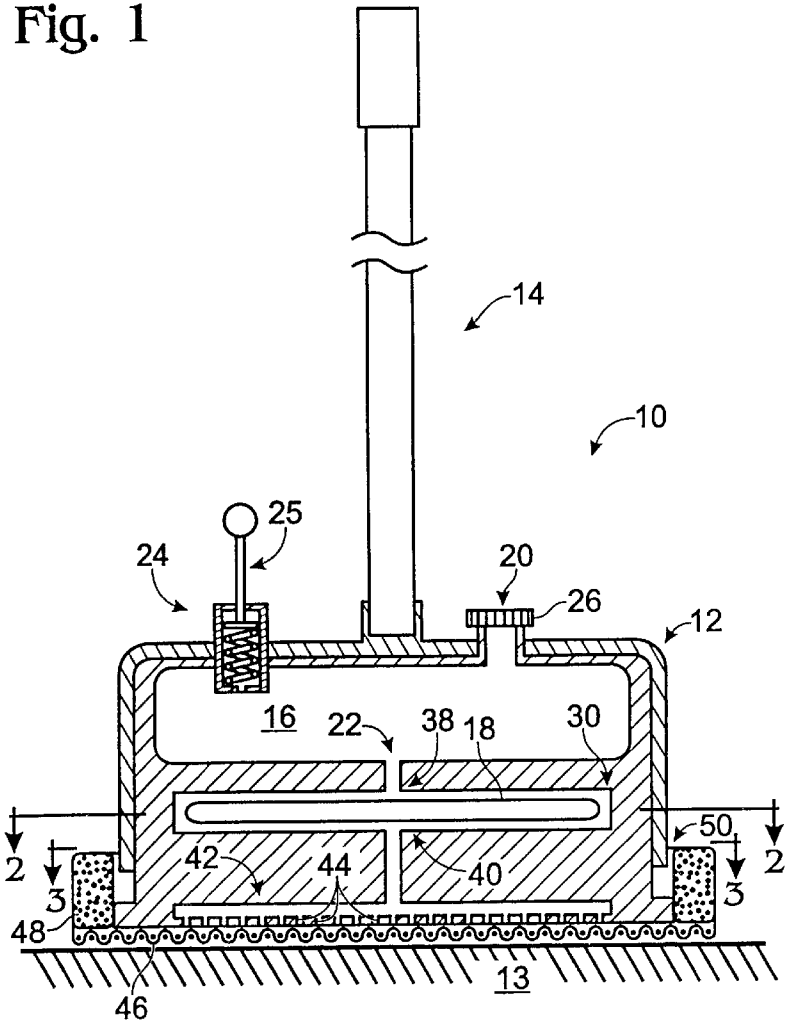
FIG. 1 is a side cross-section of a steam mop according to the present invention.

Referring to FIG. 1, a steam mop 10 according to the present invention is shown. The steam mop includes a housing 12 and a handle 14 extending upwardly from the housing 12. The housing 12 houses steam producing elements to be described below. The handle is provided to be long enough to permit a user of the steam mop 10 to maneuver the housing 12 on a floor surface 13 which it is desired to steam clean from a standing position, the handle extending at least about 2–3 feet above the floor surface.

The housing 12 contains steam producing elements including a water reservoir 16 and a separate heating plate 18 outside the water reservoir. Preferably, the water reservoir is filled through a water inlet 20 and has a relatively small water outlet 22 through which water is dispensed to the heating plate at a substantially steady rate under the influence of gravity. However, the water may be introduced into and dispensed from the reservoir 16 by other means as known in the art without departing from the principles of the invention.

The reservoir 16 is not provided with an internal heating element as is typical of boilers in the prior art. Rather, the heating means for heating the water is provided outside the reservoir by the heating plate 18. Only the water that is dispensed from the reservoir is heated by the heating plate, which is therefore able to bring this water to high temperature very quickly as compared to the time required to heat all of the water in the reservoir. One outstanding advantage of this strategy is that control of the rate of flow of water from the reservoir to the heating plate provides substantially immediate control of the amount of steam produced.

In accord with the invention, the reservoir preferably includes a mechanism 24 for increasing the rate of flow of water through the outlet 22. The mechanism 24 is preferably a pump such as shown in FIG. 1 for increasing the pressure in the reservoir when a plunger 25 of the pump is pressed. The plunger is operably connected to a piston in a cylinder, the plunger being spring biased so that pressing down on the plunger increases pressure in the reservoir. A cap 26 is provided over the inlet 20 to maintain the pressure developed by the pump which is therefore relieved by additional water exiting the outlet 22. Pressing the plunger 25 provides a "burst of steam" feature similar to that provided in modern irons.

Figure 2:
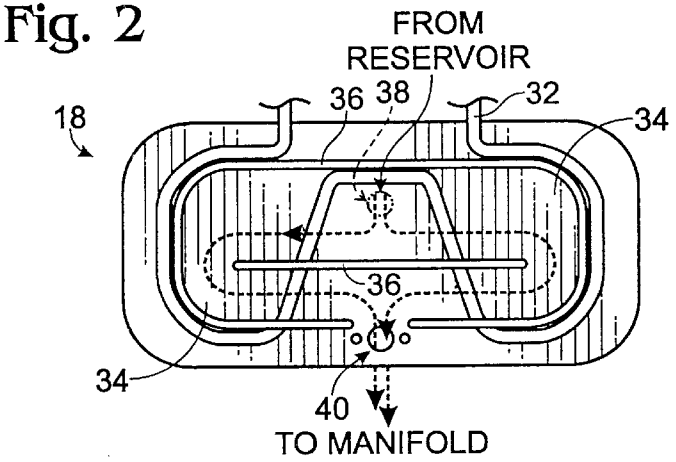
FIG. 2 is a plan view of the interior of a heating element according to the present invention for the steam mop of FIG. 1, taken along a line 2—2 thereof.

Referring to FIG. 2, the heating plate 18 is shown with a cover 30 (FIG. 1) removed. The heating plate is formed of a heat conductive material, preferably metal and includes a heating element 32 preferably cast into the heating plate. Channels 34 are formed between upwardly projecting sidewalls 36 to guide the water received from the reservoir in the direction of the arrows, from an inlet 38 to the heating plate which is in fluid communication with the outlet 22 of the reservoir, through the channels 34 and out an outlet 40 of the heating plate.

Referring back to FIG. 1, the outlet 40 guides steam produced by the heating plate through a manifold 42 that has a plurality of holes 44 disposed at the bottom of the housing 12. Preferably, a removable cloth 46 is placed over the bottom of the housing, and the housing rides on the surface 13 of the floor on the cloth as shown in FIG. 1. Sliding the apparatus over the floor surface on the cloth abrades soil or other undesirable material ("soil material") on the floor tending to displace or loosen the soil material from the floor. In addition, the cloth absorbs the soil material that has been displaced or loosened. Since the cloth is removable, it is easily cleaned when it has become saturated with soil material.

Figure 3:
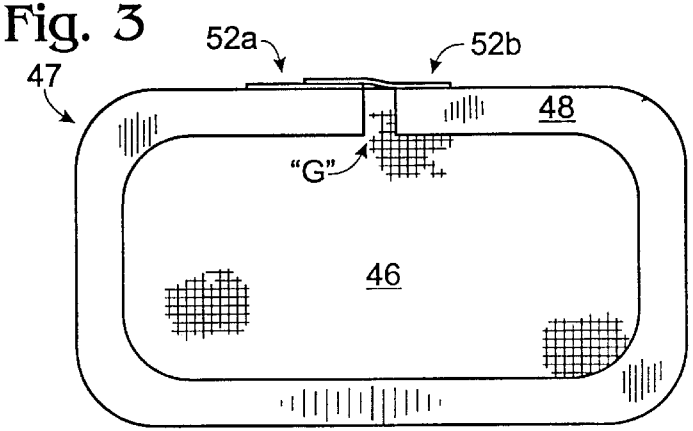
FIG. 3 is a plan view of a removable cloth member according to the present invention for the steam mop of FIG. 1, taken along a line 3—3 thereof.

With reference to both FIGS. 1 and 3, according to another aspect of the invention, the cloth 46 is provided as part of an assembly 47 including an upstanding perimeter frame 48 that extends from the cloth substantially perpendicularly to form a cavity 49. The perimeter frame is preferably formed of a flexible foamed polymer core and may be covered with a denser or less porous covering material to avoid accumulating soil material in the foamed material. The cloth may be attached to the core, or the core and covering material, with, e.g., thread or an adhesive. The perimeter frame has an interior shape and dimensions appropriate for fitting snugly with the bottom perimeter 50 of the housing 12.

The perimeter frame may additionally be provided with a gap "G", so that it extends less than 360 degrees around the perimeter 50 of the housing and so that two ends of the perimeter frame are spaced apart. An elastic band may be passed through the perimeter frame, e.g., through the core or between the core and the covering material, the ends of which include a complementary portion 52*a,* 52*b* of a fastener.

The cloth assembly 47 is easily fitted to the housing 12 by lifting the mop 10 a few inches off the floor, i.e., a sufficient amount to clear the perimeter frame 48, sliding the assembly underneath the mop, and setting the housing of the mop down inside the perimeter frame. Where the fastener 52 is provided, the ends are pulled toward one another and fastened together with the fastener to tighten the perimeter frame against the sides of the housing and thereby more snugly secure the cloth assembly 47 to the steam mop 10. The fastener 52 is preferably a hook and loop fastener, but may be any other type of fastener that is deemed suitable.

It is to be recognized that, while a particular sidecar steering aid has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A steam mop for steam cleaning a floor surface, comprising:

a housing for resting on the floor surface;

a handle connected to said housing and projecting upwardly therefrom a sufficient amount to permit maneuvering the housing on the floor surface from a standing position;

a water reservoir contained within said housing for storing water, said water reservoir including a water outlet;

a heating plate outside said water reservoir, said heating plate for receiving water from said water outlet at a first flow rate; and a flow rate increasing mechanism adjustable on demand by a user and operably coupled to said water reservoir for increasing the pressure and flow of water through said outlet as a result of adjustment to a rate that is substantially greater than said first flow rate.

2. The steam mop of claim 1, wherein said flow rate increasing mechanism includes a pump for increasing the pressure in said water reservoir.

3. The steam mop of claim 2, wherein said pump includes a spring biased plunger that is adapted to be pressed by a user to increase the pressure in said water reservoir.

4. The steam mop of claim 3, wherein said reservoir includes a water inlet for introducing water into said reservoir, the mop further comprising a cap adapted to seal said water inlet against said pressure.

5. The steam mop of claim 1, further comprising a cloth assembly comprising a perimeter frame adapted for fitting around a bottom perimeter of said housing and a water absorbent material attached to said perimeter frame.

6. The steam mop of claim 5, wherein said absorbent material is cloth and wherein said perimeter frame is relatively stiff compared to said cloth and relatively flexible compared to said housing.

7. The steam mop of claim 6, wherein said perimeter frame includes a gap defining two ends of said perimeter frame, and a fastener adapted to bind said two ends together.

8. The steam mop of claim 7, wherein said fastener comprises a complementary hook and loop fastener pair coupled respectively to said ends.

9. The steam mop of claim 1, wherein said flow rate mechanism is a spring biased plunger operably coupled to a piston, wherein pressing down on said plunger increases the pressure in said reservoir to release a burst of steam.

10. The steam mop of claim 1, wherein said heating plate includes channels for guiding the water.

11. The steam mop of claim 10, wherein sidewalls project upward from said heating plate to form said channels.

12. A steam mop for steam cleaning a floor surface, comprising:

a housing for resting on the floor surface;

a handle connected to said housing and projecting upwardly therefrom a sufficient amount to permit maneuvering the housing on the floor surface from a standing position;

a water reservoir contained within said housing for storing water, said water reservoir including a water outlet;

a heating plate outside said water reservoir, said heating plate for receiving water from said water outlet at a first flow rate; and a flow rate increasing mechanism adjustable on demand by a user and operably coupled to said water reservoir for increasing the flow of water through said outlet as a result of adjustment to a rate that is substantially greater than said first flow rate, wherein said flow rate increasing mechanism includes a pump for increasing the pressure in said water reservoir, said pump including a spring biased plunger that is adapted to be pressed by a user to increase the pressure in said water reservoir.

13. A removable cloth assembly for a steam mop having a housing for resting on a floor surface, comprising an absorbent cloth material having a perimeter and a frame extending along at least a portion of said perimeter creating a cavity in the cloth assembly for receiving said mop and producing a friction fit by exerting an inwardly directed force on said mop; wherein said perimeter frame is relatively stiff compared to said cloth and relatively flexible compared to the housing.

14. The steam mop of claim 13, wherein said frame includes a gap defining two ends of said perimeter frame, and a fastener adapted to bind said two ends together.

15. The steam mop of claim 14, wherein said fastener comprises a complementary hook and loop fastener pair coupled respectively to said ends.

* * * * *